US005652956A

United States Patent [19]

Hoshizaki et al.

[11] Patent Number: 5,652,956

[45] Date of Patent: Aug. 5, 1997

[54] ADJUSTABLE SHIN PAD

[75] Inventors: T. Blaine Hoshizaki, Montreal West; René Bourque; Rodrigue McDuff, both of Laval; Daniel Chartrand, Deux-Montagnes, all of Canada

[73] Assignee: Canstar Sports Group, Inc., Canada

[21] Appl. No.: 524,514

[22] Filed: Sep. 7, 1995

Related U.S. Application Data

[63] Continuation of Ser. No. 159,322, Nov. 30, 1993, abandoned.

[30] Foreign Application Priority Data

Dec. 2, 1992 [CA] Canada ..... 2084329

[51] Int. Cl.[6] ..... A41D 13/06

[52] U.S. Cl. ..... 2/22

[58] Field of Search ..... 2/22, 23, 24, 16, 2/62; 602/16, 20, 23, 26

[56] References Cited

U.S. PATENT DOCUMENTS

| | | | |
|---|---|---|---|
| 2,484,494 | 10/1949 | Ferguson | 2/24 |
| 2,565,762 | 8/1951 | Ferguson | 2/22 |
| 2,733,443 | 2/1956 | Holder | 2/22 |
| 2,982,968 | 5/1961 | Groot | 2/22 |
| 4,627,108 | 12/1986 | Jarvinen . | |
| 5,038,761 | 8/1991 | Richardson | 2/24 X |
| 5,477,559 | 12/1995 | Clement | 2/22 |

FOREIGN PATENT DOCUMENTS 863554 2/1971 Canada .

*Primary Examiner*—Paul C. Lewis

*Attorney, Agent, or Firm*—Finnegan, Henderson, Farabow, Garrett & Dunner, L.L.P.

[57] ABSTRACT

A shin pad is described in which the shin shield is in two pieces, namely an upper piece which is secured to the lining of the knee cap, or to the knee cap itself, and a lower piece which is slidable up and down relative to the upper piece, and to which a lower liner is secured, the lower liner being independent of the knee liner. Preferably, the lower piece is slidable with respect to the upper piece by virtue of one or more slotted holes in either or both of the upper piece and/or lower piece, with bolts and T-nuts being used in the slots to secure the pieces together in the desired position. Preferably, there are three such slotted holes, namely a front central one and two side ones, namely one towards either side of the pad. Preferably, there is sufficient sloppiness in the slots to provide a varus/valgus adjustment, i.e. an adjustment of the angle of the shin shield, in the vertical fore-and-aft plane, relative to the orientation of the knee cap, by permitting the lower piece to be secured with one side higher than the other relative to the upper piece.

6 Claims, 5 Drawing Sheets

ADJUSTABLE SHIN PAD

This application is a continuation of application Ser. No. 08/159,322, filed Nov. 30, 1993, now abandoned.

BACKGROUND OF THE INVENTION

1. Field of the Invention

This invention relates to shin pads for use as protective gear in contact sports, especially ice hockey.

2. Description of the Prior Art

In ice hockey, shins protectors (more commonly referred to as "shin guards" or "shin pads") conventionally have a flexible elongated padded portion which may be arranged to wrap partially around the front of a player's lower leg, from the ankle to just above the knee. (The common term "shin pad" is therefore slightly misleading, since protection for the knee is also provided.) Rigid or semi-rigid plastic shield members are secured to the pad, namely a shin shield running from the ankle to just below the knee, and a knee shield covering the knee. Separate shield members are used, to allow the pad to flex to accommodate bending of the knee.

The shield members are conventionally sewn or riveted to the pad. For example, it is common to sew the knee shield to the pad, and to rivet the shin shield to the pad with large rivets in several spaced-apart locations. The knee shield moves with the knee when the player flexes his leg, simply by the flexibility of the pad.

The length of the pad is fixed, so that as a young player grows, the pad cannot continue to be used for possibly an additional season or two, unless optimum protection is sacrificed. Similarly, the pad cannot be shared by two players, such as where a family has several hockey-playing children who may wish to share equipment.

Furthermore, the length of the pad cannot be optimized to suit the individual ideally.

It would therefore be desirable to have a shin pad which allowed for at least some adjustment in length. At the same time, it would be desirable to have a shin pad which would have a varus/valgus adjustment for further optimization to fit the player ideally.

SUMMARY OF THE INVENTION

It is therefore an object of the invention to provide a shin pad where the length of the shin shield portion is adjustable, and where preferably there is also a varus/valgus adjustment.

Therefore, in the invention, the shin shield is in two pieces, namely an upper piece which is secured to the lining of the knee cap, or to the knee cap itself, and a lower piece which is slidable up and down relative to the upper piece, and to which a lower liner is secured, the lower liner being independent of the knee liner.

Preferably, the lower piece is slidable with respect to the upper piece by virtue of one or more slotted holes in either or both of the upper piece and/or lower piece, with bolts and T-nuts being used in the slots to secure the pieces together in the desired position.

Preferably, there is a certain degree of deliberate "sloppiness" in the slots, so as to provide a varus/valgus adjustment, i.e. an adjustment of the angle of the shin shield relative to the vertical fore-and-aft plane and thus relative to the orientation of the knee cap.

With the length adjustment and varus/valgus adjustment, it is possible to optimize the pad configuration for a particular player in a manner which has only been possible in the past through custom non-adjustable pads.

It will be appreciated that although the invention is especially designed for use in the sport of ice hockey, the same general construction could be readily adapted for use in shin pads in other sports where similar protection is required. The invention as defined in the appended claims is therefore not limited to ice hockey equipment.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
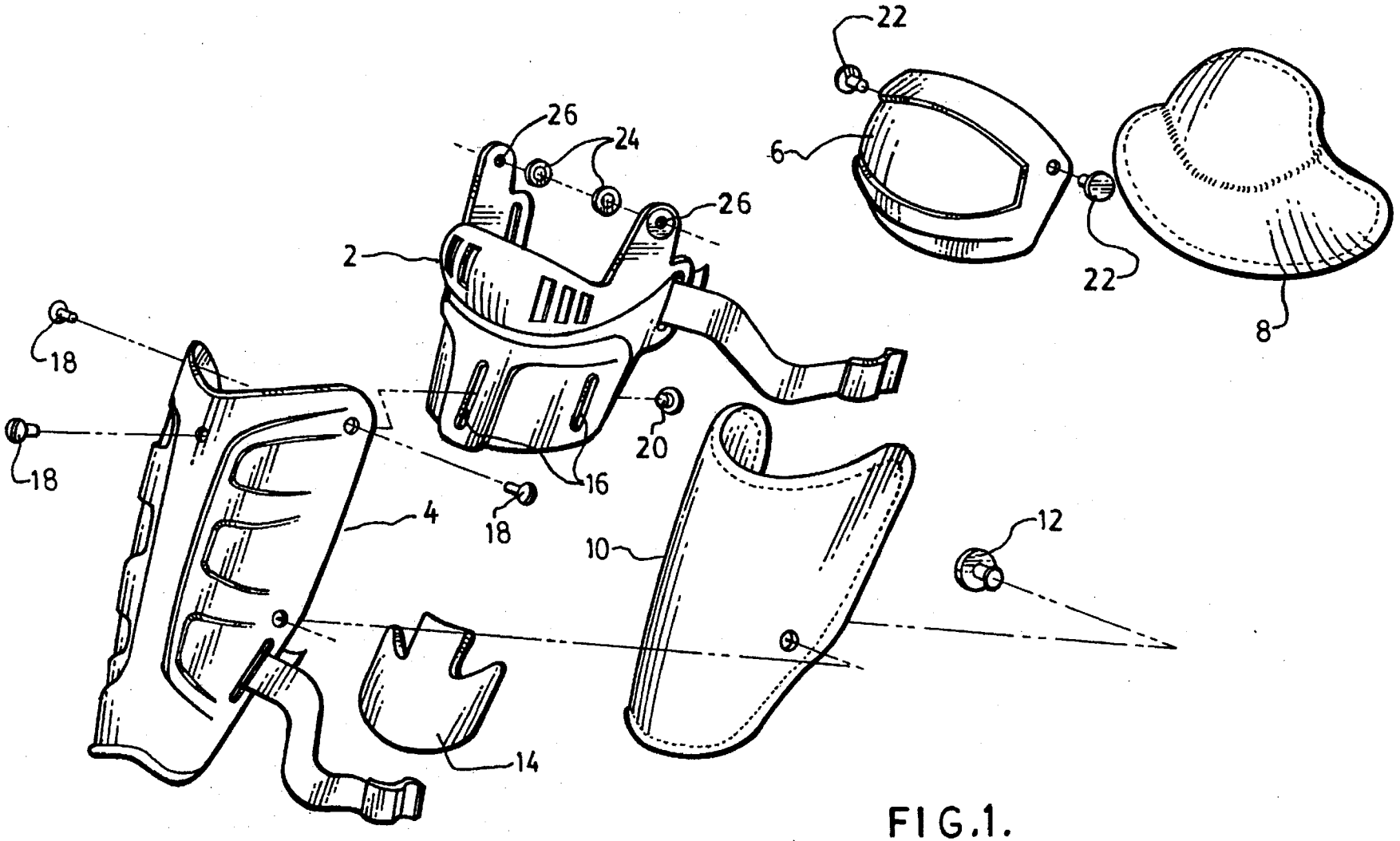
FIG. 1 is an exploded perspective view of the preferred embodiment.
Figure 2:
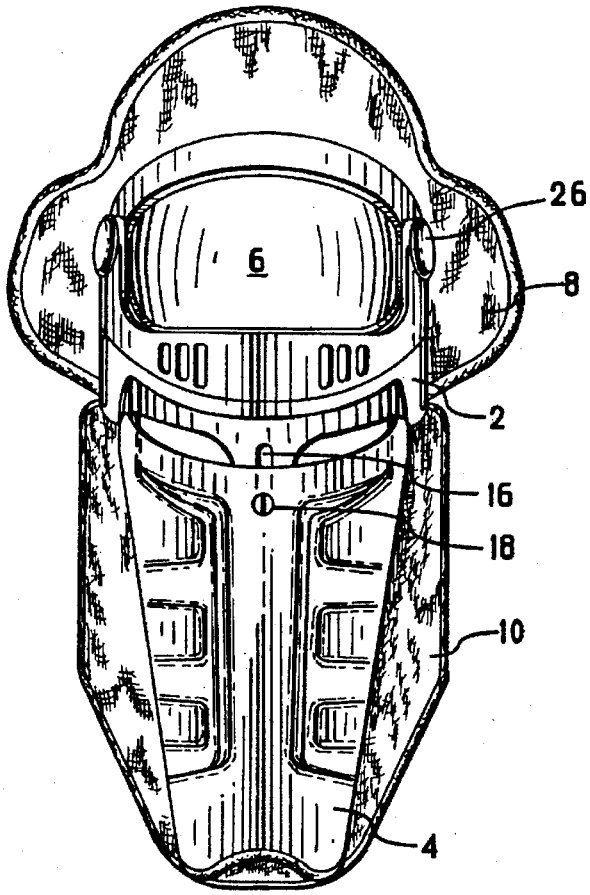
FIG. 2 is a front elevation view of the preferred embodiment, at maximum length.
Figure 3:
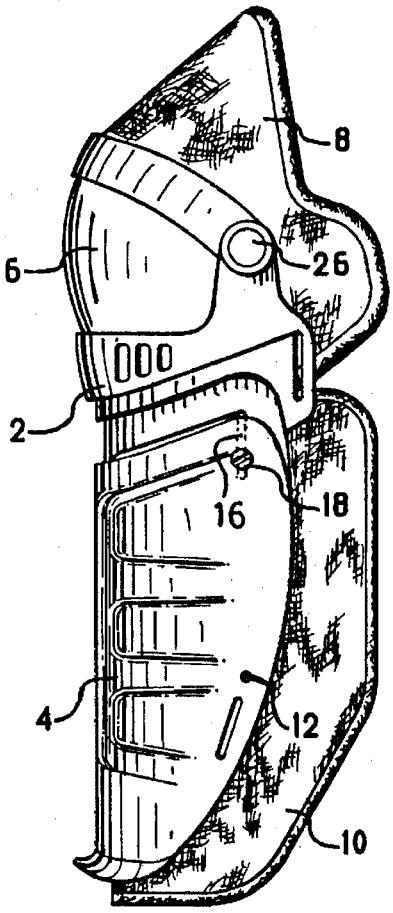
FIG. 3 is a side elevation view of the preferred embodiment, at maximum length.
Figure 4:
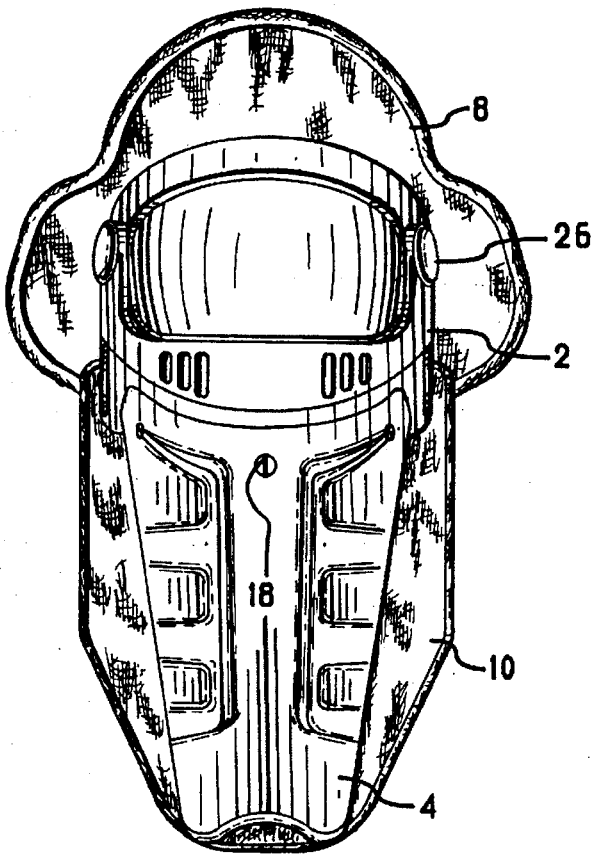
FIG. 4 is a front elevation view of the preferred embodiment, at minimum length.
Figure 5:
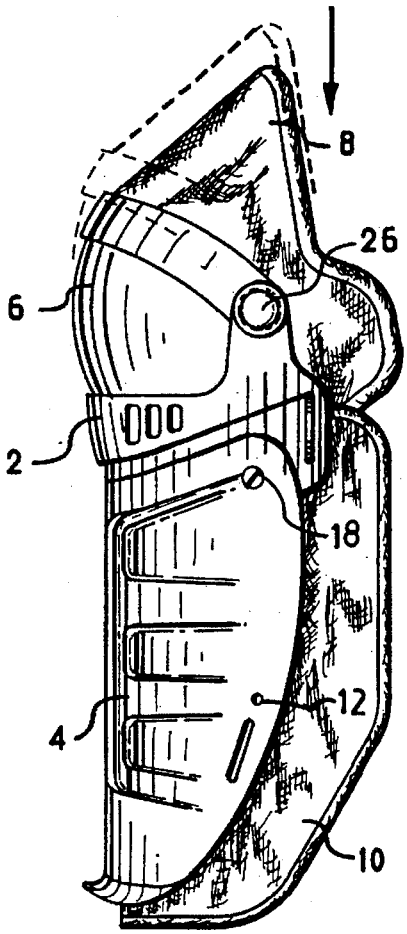
FIG. 5 is a side elevation view of the preferred embodiment, at minimum length.
Figure 6:
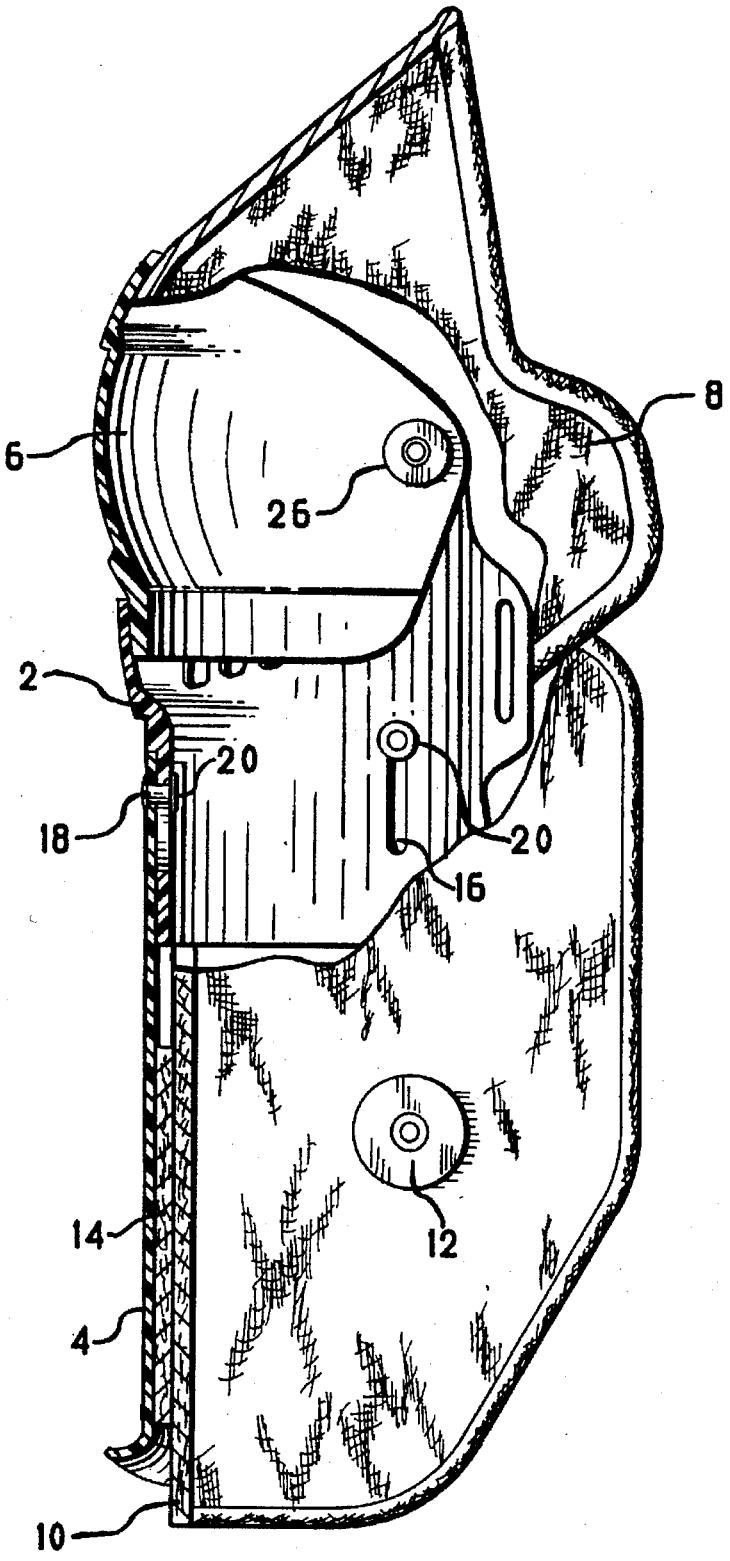
FIG. 6 is a side cross-sectional elevation view.

Referring to the drawings, the shin pad includes a two-piece shin shield, comprising an upper piece 2 and a lower piece 4. The upper piece in the preferred embodiment is pivotally fastened to the knee cap 6, which is sewn or otherwise secured to the knee liner 8, but the upper piece could be secured to the knee liner instead. The lower piece 4 is slidable up and down relative to the upper piece. A lower liner 10 is secured to the lower piece via clips 12, and is independent of the knee liner. A foam insert 14 may also be provided for additional cushioning.

The lower piece is slidable with respect to the upper piece by virtue of one or more slotted holes in either or both of the upper piece and/or lower piece. In the preferred embodiment, the upper piece has three slotted holes 16, namely two towards either side of the upper piece and one in the front. Bolts 18 and T-nuts 20 are used in the slots to secure the pieces together in the desired position.

In the preferred embodiment as illustrated, the knee cap 6 is pivotally mounted on the upper piece 2 by virtue of bolts 22 and nuts 24 at pivot points 26 on the lateral and medial sides of the knee.

The length of the slots is approximately as illustrated in the drawings, thereby allowing a corresponding variation in length of the shin pad. Obviously, the length of the slots could be varied, although there is no intention to produce a shin pad which will cover a large range of lengths; that is not possible, since the other components must change size proportionately.

Figure 7:
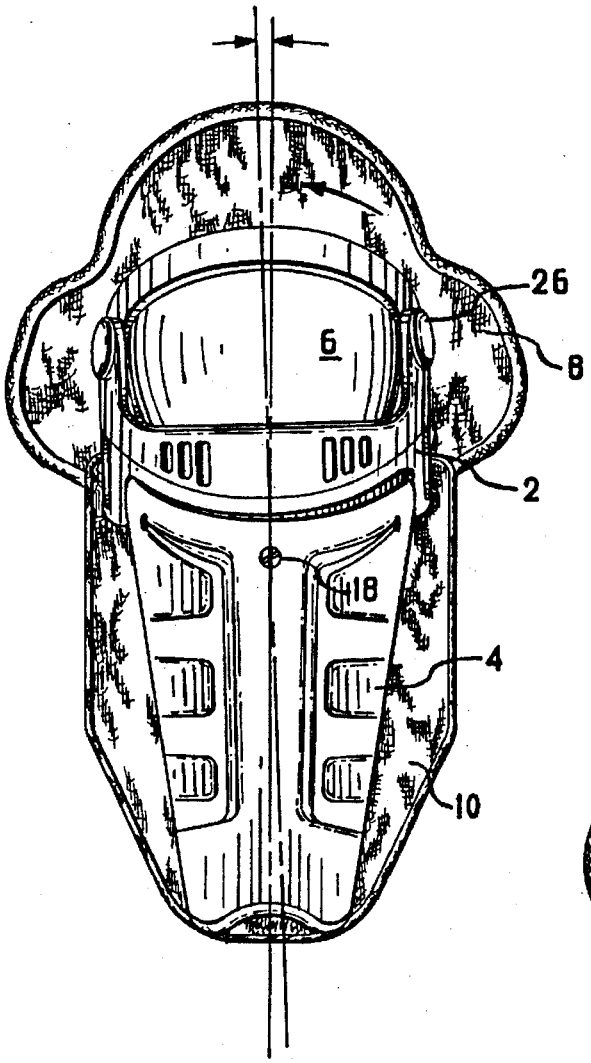
FIGS. 7 and 8 are front elevation views, showing the varus/valgus adjustability of the pad.
Figure 8:
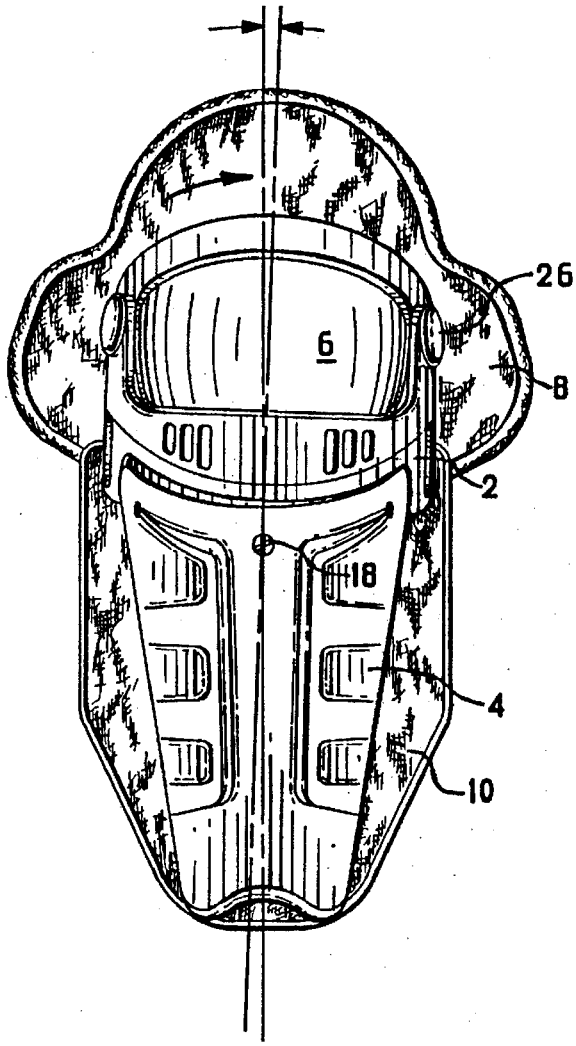

Preferably, there is a certain degree of "sloppiness" in the slots, which is inevitably somewhat inherent, but which is adjusted so as to provide a varus/valgus adjustment, i.e. an adjustment of the angle of the shin shield relative to the vertical fore-and-aft plane and thus relative to the orientation of the knee cap. This adjustment is provided, as illustrated in FIGS. 7 and 8, by fastening one side or the other of the shin shield 4 higher than the other side, i.e. farther up in the slot 16.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A shin and knee pad assembly for sports, comprising:

a shin pad portion, comprising shin padding material positionable along and partially around a person's shin, and a rigid plastic shield extending along a substantial portion of a front surface of the shin padding material; and a separate knee pad portion, comprising knee padding material positionable over a person's knee, and a rigid plastic shield across a substantial portion of a front surface of said knee padding material, said shin pad portion having separate upper and lower pieces, the upper piece being secured to said knee pad portion, the lower piece having means for slidably fastening the lower piece to the upper piece, for sliding movement up and down relative to the upper piece, whereby the overall length of said shin pad portion may be varied.

2. A shin and knee pad assembly as recited in claim 1, wherein said means for slidably fastening the lower piece to the upper piece comprises one or more vertically-oriented slotted holes in at least one of the lower and upper pieces, and the fastening means passes through the slotted holes.

3. A shin and knee pad assembly as recited in claim 2, wherein the vertically-oriented slotted holes are positioned in at least two laterally spaced-apart locations.

4. A shin and knee pad assembly as recited in claim 3, having three vertically-oriented slotted hole locations including a first hole location being generally centrally located, the remaining hole locations being laterally spaced apart therefrom, and one of each of the remaining hole locations being located on either side of said shin pad portion.

5. A shin and knee pad assembly as recited in claim 2 or 3, wherein said slotted holes provide means for securing the lower piece to the upper piece at a plurality of different angles relative to a vertical fore-and-aft plane of the upper piece.

6. A shin and knee pad assembly as recited in claim 4, wherein the lower piece is secured to the upper piece at a plurality of different angles relative to a vertical fore-and-aft plane of the upper piece.

* * * * *